US006296209B1

(12) United States Patent
Bobb

(10) Patent No.: US 6,296,209 B1
(45) Date of Patent: Oct. 2, 2001

(54) RAILROAD SWITCH STAND

(76) Inventor: Frank P. Bobb, 3475 Green St., Camp Hill, PA (US) 17011

( * ) Notice: Subject to any disclaimer, the term of this patent is extended or adjusted under 35 U.S.C. 154(b) by 0 days.

(21) Appl. No.: 09/295,137

(22) Filed: Apr. 20, 1999

(51) Int. Cl.[7] ..... B61L 5/02

(52) U.S. Cl. ..... 246/393; 246/358; 246/382; 464/30

(58) Field of Search ..... 246/393, 428, 246/415, 476, 405, 358, 382, 389, 392, 407, 412, 413; 464/30; 403/2

(56) References Cited

U.S. PATENT DOCUMENTS

| | | | | |
|---|---|---|---|---|
| 296,808 | * | 4/1884 | Witty | 246/489 |
| 452,543 | * | 5/1891 | Gibson | 246/406 |
| 534,761 | * | 2/1895 | Rowlands | 246/406 |
| 1,272,235 | * | 7/1918 | Dostie | 464/30 |
| 2,409,385 | * | 10/1946 | Pletcher | 464/30 |
| 4,938,438 | * | 7/1990 | Farrell et al. | 246/406 |
| 5,495,660 | * | 3/1996 | Choi | 29/732 |

FOREIGN PATENT DOCUMENTS

| | | | | |
|---|---|---|---|---|
| 14103 | * | 11/1879 | (DE) | 246/393 |
| 1382106 | * | 11/1964 | (FR) | 246/393 |

* cited by examiner

*Primary Examiner*—S. Joseph Morano
*Assistant Examiner*—Frantz F. Jules
(74) *Attorney, Agent, or Firm*—Richard O. Church

(57) ABSTRACT

A railroad switch stand for moving a pair of switch points between two rails includes a vertically disposed spindle rotating about its principal axis and terminating adjacent its lower end in a stub shaft in which the spindle has a necked section of reduced diameter above the stub shaft including vertically aligned bench marks inscribed on the spindle immediately above and below the section of reduced diameter of the shaft, a horizontal crank threadingly engaged with the stub shaft and a connecting rod.

1 Claim, 2 Drawing Sheets

RAILROAD SWITCH STAND

FIELD OF THE INVENTION

The present invention relates to railroad switch stands for moving a pair of switch points between two rails to divert rolling stock from one track to another. More particularly, this invention relates to improved railroad switch stands that have adjustable linkages, that can isolate damages when there is a run through and that provide a visual indication when the switch stand has suffered damage.

DESCRIPTION OF THE PRIOR ART

In switching rolling stock from one set of rails to another, a pair of stationary rails and a pair of switching rails are arranged so that the switching rails can be moved either to keep trains on a main track or divert them to a branch track. The switching rails are moved by a switching device which includes a connecting rod that extends horizontally beneath the tracks to points of connection with the switching rails.

A switching device typically includes a switch stand at one side of the rails which can be operated either manually or automatically. The switch stands of the type with which this invention is concerned are sometimes referred to as the "Model 51 New Century" which have been in use since the early 1900's with little modification. When operated by hand, a weighted lever arm lying horizontally on the ground or at the base of the switch stand can be lifted and thrown through an arc of 180° to the opposite side of the switch stand where it again will rest horizontally on the ground or base. It is common practice to mount a pinion gear at the pivot end of the lever arm which, through a mating segment gear arrangement in the switch stand rotates a vertically disposed spindle. A horizontally disposed crank is secured to the lower end of the spindle. The end of the crank that is remote from the axis of the spindle carries an end fixture adapted to engage the connecting rod. By these means, rotation of the spindle, acting through the crank, imparts a reciprocating movement to the connecting rod which, in turn, positions the switch points. One of the early designs of a switch stand of this general type is disclosed in U.S. Pat. No. 401,671 issued to Alkins in 1889.

This basic switch stand, as modified over the years, is still in common use today despite several disadvantages and failings. As discussed above, a crank is utilized to link the movement of the spindle to the connecting rod. Each crank has a radius arm defined by the distance between the axis of the spindle and the attachment point to the connecting rod. As the length of the radius arm may vary somewhat from one installation to another, a number of cranks with different radius arms are kept in inventory to accommodate the requirements of a given switch stand assembly.

Another weakness in the design of switch stands is that they may suffer anywhere from a major damage to total destruction caused by a run through—that is, when a train passes the wrong way through a closed switch.

SUMMARY OF THE INVENTION

It is an object of this invention to provide a switch stand that is protected from major damage if there is a run through.

Another object of this invention is to provide a switch stand that can be easily repaired and rapidly put back in service after it has been damaged as in a run through.

A further object of the invention is to design a switch stand that will provide a visual indication that the switch stand has been damaged and needs repair even though the switch stand appears to be working properly.

DETAILED DESCRIPTION OF THE DRAWINGS

Figure 1:
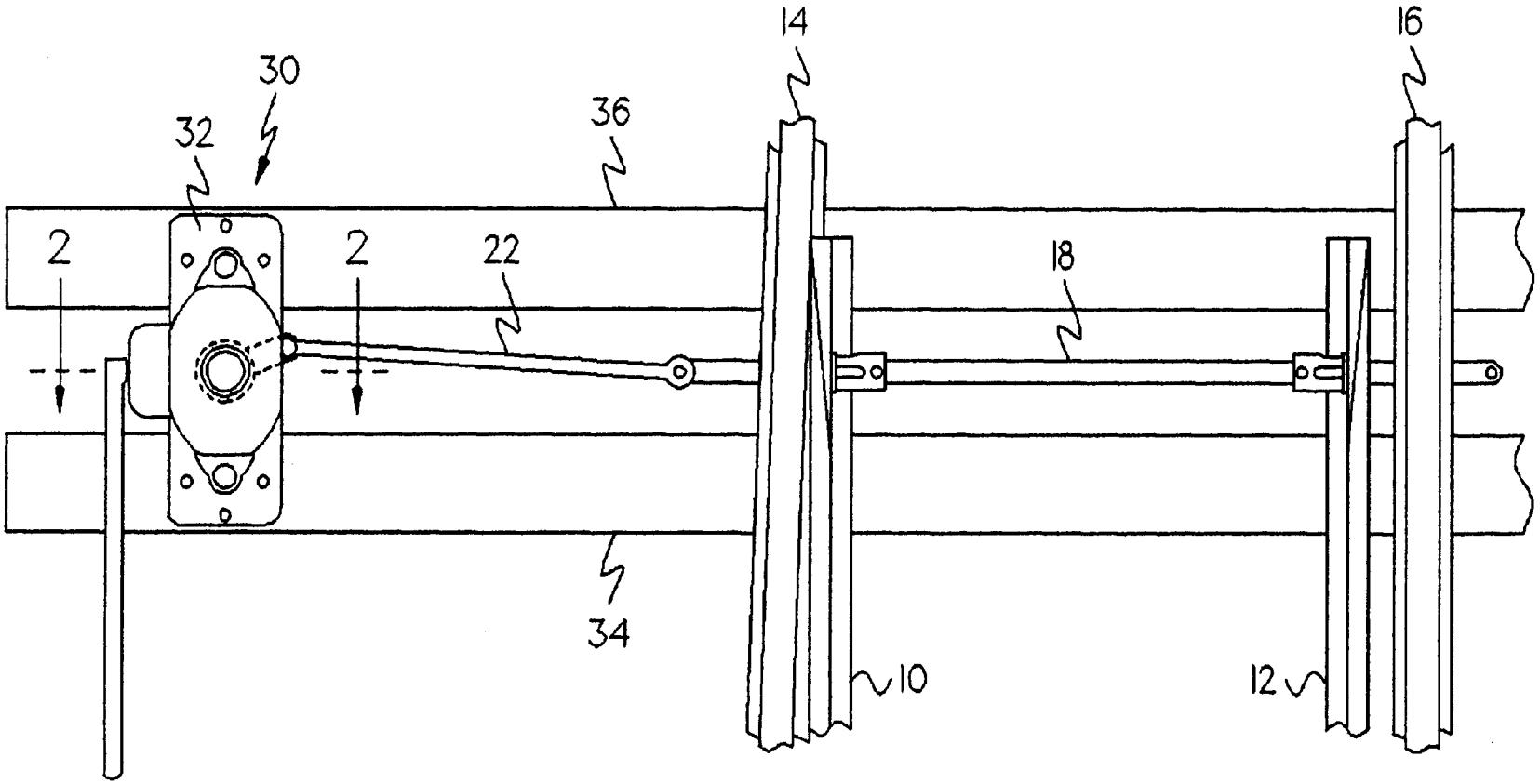
FIG. 1 is a plan view of a pair of stock rails and a pair of switch points illustrating the connection of the switch points to a switch stand via a connecting rod.

Turning to FIG. 1 of the drawings it may be observed that a pair of switch points 10 and 12 lie between a pair of stock rails 14 and 16. The switch points 10 and 12 are connected by a laterally extending switch rod 18. A connecting rod 22 serves to connect the switch rod 18 to a switch stand 30. The switch stand 30 has a base 32 which mounts the stand on a pair of adjacent railroad ties 34 and 36.

In the operating position of the switch stand 30 depicted in FIG. 1, the switch point 10 rests against the stock rail 14. Upon operation of the switch stand 30 to its second operating position the connecting rod 22 and the switch rod 18 are moved to the right such that the switch point 10 moves away from the stock, rail 14 and the switch point 12 is moved into contact with stock rail 16. Thus, it may be seen that operation of the switch stand 30 between its two operating positions causes the connecting rod 22 to be extended in one direction to move the switch rod 18 and the switch points 10 and 12 from a position in which one switch point lies against one stock rail to a position in which the opposite switch point lies against the opposite stock rail.

Figure 2:
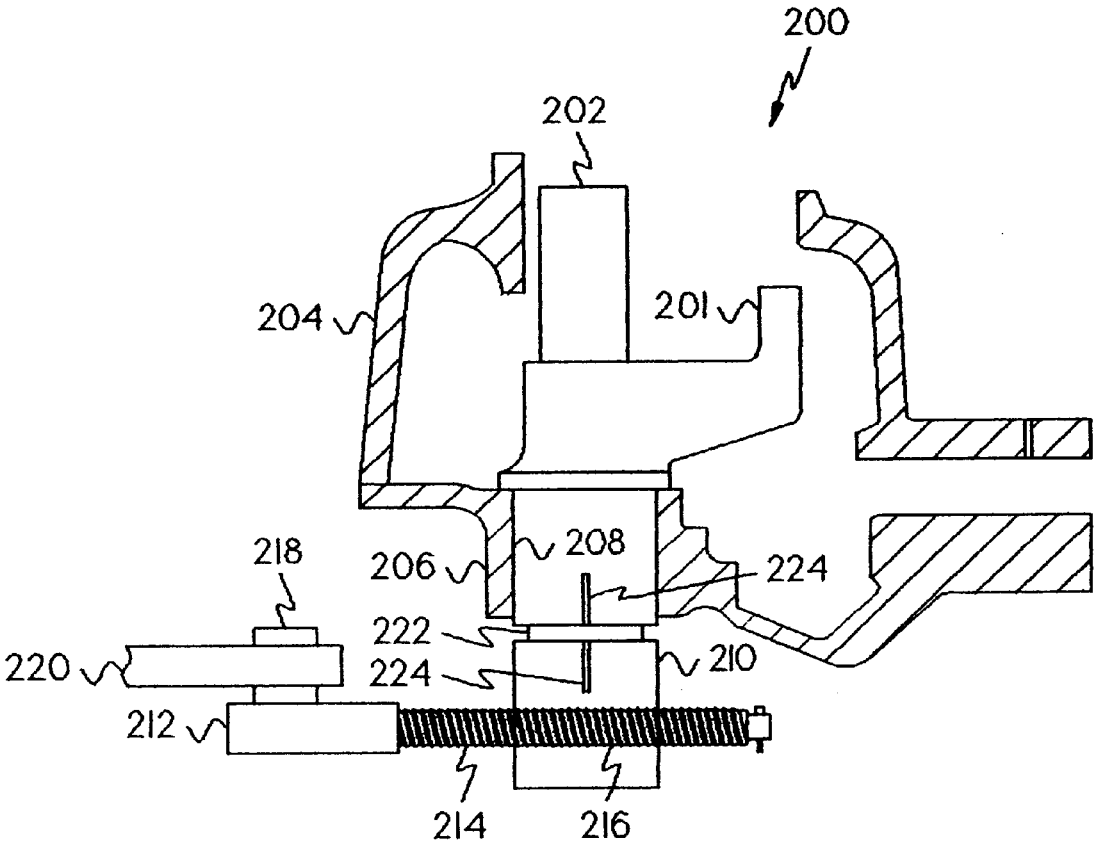
FIG. 2 is a side view, partially in section, illustrating a switch stand made in accordance with this invention.

FIG. 2 illustrates the working mechanisms of the switch stand 200 which enables switching rolling stock from one set of rails to another. Quite generally the switch stand 100 is comprised of a spindle 202 which terminates at its lower end in a stub shaft 210. A crank 112 is adjustably attached to the stub shaft 210 by a threaded rod 214. The threaded rod 214 can be advanced or retracted within a drilled and tapped passageway 216 in stub shaft 210 to permit adjustment of the radius an of the crank 212.

The spindle 202 is mounted within the housing 204. The lower portion of the housing 204 is machined to form a sleeve bearing 206. This permits a machined surface 208 of the spindle 202 to rotate within the sleeve bearing 206.

For purposes of this invention, the mechanism for rotating the spindle is of no particular consequence. Thus a hydraulic or an electric motor may be used to rotate the spindle 102. More conventionally, however, switch stands include a gear segment (not shown) which is engaged by a pinion gear (not shown) mounted at the end of the lever arm. The gear segment is mechanically linked to the spindle 202 by means of a securing pin 201.

The stub end 210 of the spindle 202 has a necked portion 222 which is of smaller diameter than the stub shaft 210. The purpose of this neck 222 is to provide a shear point if there is a train run through. In this instance the spindle will yield at the neck 222 and the other operating parts of the switch stand such as the gear segment and pinion will be protected from damage and the switch stand may be restored to working order by replacing the spindle 202.

The stub shaft 210 is provided with small vertically align markings 224 that are readily visible to anyone inspecting the switch stand. If there is a run through, the stub shaft will twist at the necked portion 222 of the stub shaft 210 and, if the forces are great enough, the stub shaft 210 will be severed at the neck 222 before any other damage is done to the switch stand. If however, the forces are sufficient to twist the stub shaft 210 at its neck 222 but not enough to sever it, the lined markings 224 will no longer be in alignment with each other, thus indicating to a workman that the switch stand should be inspected for further damage and the spindle 202 replaced.

It can be seen that threaded rod 214 will adjust the radius of the crank 212 by simply rotating the threaded rod 214 in the drilled and tapped passageway 216 of the stub shaft 210. Proper adjustment requires that the connecting rod 220 can be secured over the boss 218.

In the switch stands of the prior art, a crank has been fixed to the stub shaft 210 by means of a housing that surrounds the stub shaft 210. In this construction, the radius of the crank 212 cannot be adjusted and, therefore, a number of different cranks must be kept in inventory so that one can be selected whose boss 218 is laterally positioned to accept the connecting rod 220.

The design of a switch stand 200 as here described, has a number of advantages over those of the prior art. First, a necked down portion 222 of a stub shaft 210 is provided that will twist or shear when there is a run-through of the switch. If the stub shaft 210 is sheared, all that needs be done to restore the switch stand to full operation is to replace the spindle 202 as the other mechanisms, such as the pinion segiment gears, will have been protected from harm.

On those occasions when a run-through does not impact with sufficient force to sever the stub shaft 210 at the neck, it still may twist the stub shaft far enough to compromise its future operation. This condition is revealed by inspecting the switch stand and noting whether the vertical markings 224 on the stub are aligned. If not, one is given a clear indication that the switch stand has been damaged and that the spindle 202 should be replaced.

What is claimed is:

1. A railroad switch stand for moving a pair of switch points between two rails to direct rolling stock from one track to another in which the switch points are controlled by the generally linear movement of a horizontally disposed connecting rod including:

a vertically disposed spindle mounted for rotation about its principle axis and terminating adjacent its lower end in a stub shaft in which the spindle has a necked section of reduced diameter above the stub shaft;

a horizontally disposed crank threadingly engaged at its one end with a tapped and threaded horizontally disposed hole passing through a diameter of the stub shaft and at its other end with the connecting rod to permit adjustment of the length of the radius arm of the crank; and vertically aligned bench marks inscribed on the spindle immediately above and below the section of reduced diameter of the crank.

* * * * *